US005909916A

United States Patent [19]

Foster et al.

[11] Patent Number: 5,909,916

[45] Date of Patent: Jun. 8, 1999

[54] METHOD OF MAKING A CATALYTIC CONVERTER

[75] Inventors: Michael Ralph Foster, Columbiaville; Gerald Leroy Vaneman, Grand Blanc; Jesse Allan Heather, Swartz Creek; Dana Michael Serrels, Davison; David Kwo-Shyong Chen, Rochester Hills, all of Mich.

[73] Assignee: General Motors Corporation, Detroit, Mich.

[21] Appl. No.: 08/932,713

[22] Filed: Sep. 17, 1997

[51] Int. Cl.[6] ..... B23P 15/00

[52] U.S. Cl. ..... 29/890; 29/505

[58] Field of Search ..... 29/890, 448, 449, 29/458, 515, 505; 422/177

[56] References Cited

U.S. PATENT DOCUMENTS

| | | | |
|---|---|---|---|
| 4,028,275 | 6/1977 | Sakai et al. | 252/466 PT |
| 4,148,120 | 4/1979 | Siebels | 29/890 |
| 4,969,264 | 11/1990 | Dryer et al. | 29/890 |
| 5,055,274 | 10/1991 | Abbott | 29/890 |
| 5,096,111 | 3/1992 | Ishikawa et al. | 29/890 |
| 5,119,551 | 6/1992 | Abbott | 29/890 |
| 5,285,640 | 2/1994 | Olivo | 60/274 |
| 5,329,698 | 7/1994 | Abbott | 29/890 |
| 5,330,728 | 7/1994 | Foster | 422/177 |
| 5,346,675 | 9/1994 | Usui et al. | 29/890 |
| 5,593,647 | 1/1997 | Kirby | 29/890 |

OTHER PUBLICATIONS

*Sources of Monlith Catalytic Converter Pressure Loss*, Daniel W. Wendland and Phillip L. Sorrell, SAE Paper Series No. 912372, Int'l Fuels & Lubricants Meeting, Oct. 7–10, 1991.

*Effect of Header Truncation on Monolith Converter Emission–Control Performance*; Daniel W. Wendland, William R. Matthes & Ohillip L. Sorrell, SAE Paper Series No. 922340, International Fuels & Lubricants Meeting, San Francisco, CA; Oct. 19–22, 1992.

*Primary Examiner*—Irene Cuda

*Attorney, Agent, or Firm*—Anthony L. Simon; Vincent A. Cishosz

[57] ABSTRACT

A method of manufacturing an oval shaped catalytic converter that reduces the amount of material and number of parts that are required for permitting the catalytic converter to treat the exhaust gases of an internal combustion engine and also improves the structural durability of the converter for high temperature applications by maintaining a higher mat density along the minor axis of the converter housing.

9 Claims, 5 Drawing Sheets

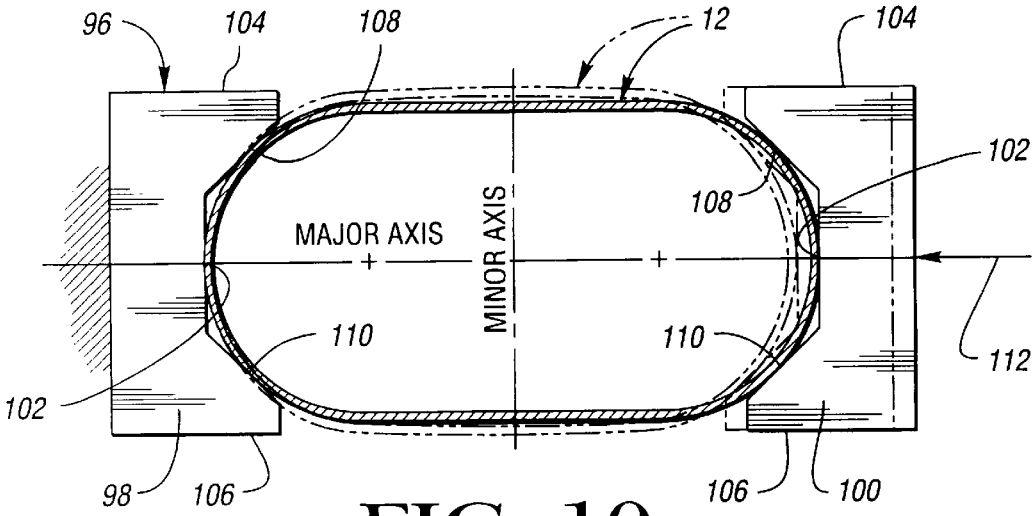
FIG. 10
FIG. 11
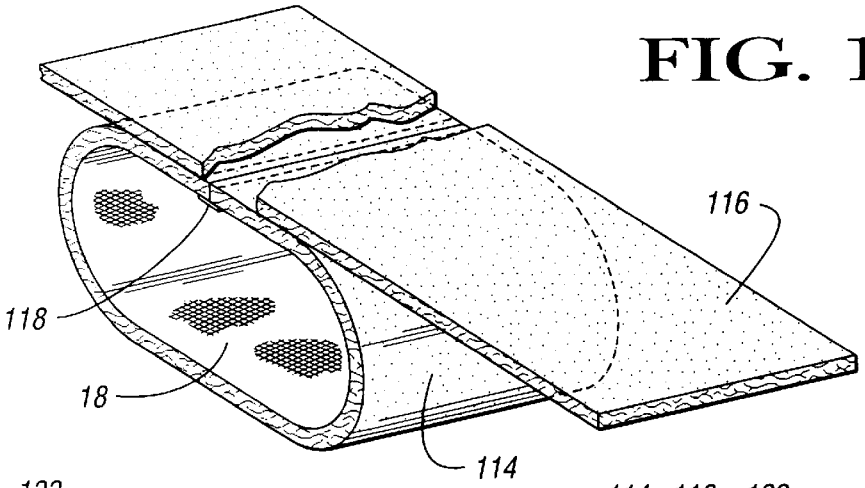
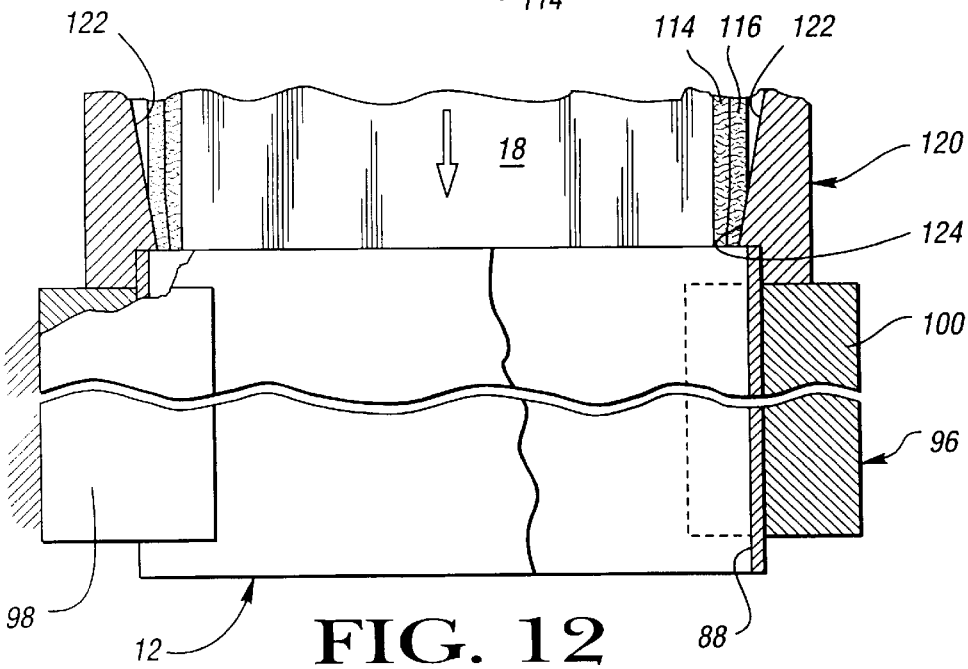
FIG. 12

METHOD OF MAKING A CATALYTIC CONVERTER

TECHNICAL FIELD

This invention concerns catalytic converters and, more particularly, is directed to a catalytic converter structure having an oval-shaped catalyst coated substrate for treating the exhaust gases of an internal combustion engine and to a method of manufacturing the catalytic converter structure.

BACKGROUND OF THE INVENTION

One form of catalytic converter presently being manufactured has an oval-shaped catalyst coated substrate made from an extruded ceramic located within an oval-shaped housing with dual wall end cones. The end cones cooperate to form air chambers at the opposed ends of the converter that serve to reduce the outside temperature of the converter and also serve to block the hot exhaust gases from impinging directly on a mat material located between the substrate and the housing.

One problem with a converter of this type is that, when the substrate together with the mat material is stuffed into the oval housing, the outer oval configuration of the housing can distort. As a result, the outer end cones which fit onto the opposed open ends of the housing are required to have large tolerances to accommodate the varying outer configurations of the housing. This then, causes some difficulty in welding the end cones to the housing. Another problem is that during high temperature operation of the converter, there is a tendency for the housing to expand along the minor axis so as to reduce the density of the mat which, in turn, reduces the life of the mat material.

It has been proposed (see SAE Technical Paper 922340, entitled "Effect of Header Truncation on Monolith Converter Emission-Control Performance", authored by Daniel W. Wendland et. al. and presented in October 1992 at the International Fuels and Lubricants Meeting and Exposition) to shorten the distance between the inlet and outlet tube and the substrate to approximately one inch. The single wall end cone design prevalent at that time, however, presents a further problem in that the mat material supporting the substrate is exposed to hot exhaust gases which, if the catalytic converter is placed in a location close to the vehicle engine where the exhaust gas temperature at the inlet of the catalytic converter is sufficiently high, will tend to erode the mat resulting in a loss of substrate retention and heat insulating capability of the mat material.

SUMMARY OF THE INVENTION

Accordingly, an object of the present invention is to provide a new and improved catalytic converter and method of manufacture that reduces the amount of material and number of parts that are required for permitting the catalytic converter to treat the exhaust gases of an internal combustion engine and also improves the structural durability of the converter by maintaining a higher mat density along the minor axis of the converter housing.

Another object of the present invention is to provide a new and improved converter and method of manufacture that utilizes an oval-shaped housing of a predetermined configuration that is initially deformed by an applied force so as to increase the size of the oval housing along its minor axis and decrease the size of the oval housing along its major axis followed by the insertion within the oval opening of a mat wrapped catalyst coated substrate after which the force applied to the housing is relieved allowing the inside surfaces of the housing to move towards their pre-deformed positions with the result that the inside surfaces of the housing along the minor axis exert increased pressure on the mat and thereby provide an increased density of the mat.

A further object of the present invention is to provide a new and improved catalytic converter and method of manufacture that utilizes an oval-shaped housing of a predetermined configuration that has a mat wrapped substrate positioned therein and afterwards is deformed by application of a compressive force applied along the minor axis of the oval opening in the housing so as to decrease the size of the oval opening within the housing along this axis followed by securing a pair of end members to the opposed ends of the housing so as to maintain the final configuration of the housing and the increased pressure applied to the mat by the compressive force.

A still further object of the present invention is to provide a new and improved catalytic converter having a oval-shaped housing in which a mat wrapped substrate made of a frangible material is centrally located and is supported from axial movement relative to the housing solely by a mat made of a resilient intumescent material and in which the housing terminates at its opposed ends with an oval opening that is closed by a planar end plate formed with an opening through which hot exhaust gases can flow and in which a plurality of locators are provided for positioning the end plate relative to the oval opening.

The above objects and others are realized in accordance with the present invention by a catalytic converter which includes an oval-shaped housing terminating at each end with an oval-shaped peripheral edge defining an oval opening located in a plane extending transversely to the longitudinal center axis of said housing. A catalyst coated substrate made of a frangible material is adapted to be located within the housing and has a cross sectional configuration similar to the oval-shaped configuration of the housing. The substrate is of a smaller size than the oval opening in the housing and is dimensioned so when the substrate alone is centrally located within the oval opening of the housing, the gap between the inside surface of the housing and the outside surface of the substrate along the minor axis of the oval opening is less than the gap between the inside surface of the housing and the outside surface of the substrate along the major axis of said oval opening. An insulating mat made of a resilient intumescent material is adapted to be wrapped around the substrate and together therewith adapted to be inserted into the housing while the housing is deformed by an applied force so as to cause the inside surfaces of the housing along the minor axis of the oval opening to move radially outwardly. In addition, a pair of end members, each of which is formed with an opening through which exhaust gases can flow, are adapted to be secured to the opposed ends of the housing by a welding operation after the applied force on the housing is relieved so as to cause the inside surfaces along the minor axis of the oval opening to be maintained in a stressed condition to apply increased pressure to the mat along the minor axis of the oval opening and thereby increase the density of the mat.

In an alternate method of manufacturing the catalytic converter, an oval-shaped housing is provided that, in its normal state, has an oval opening dimensioned so when the substrate alone is centrally located within the oval opening of the housing, the radial distance between the inside surface of the housing and the outside surface of the substrate is uniform about the circumference of the substrate. The substrate is wrapped with a mat of intumescent material and inserted through the oval opening into the cavity of the housing. Afterwards, the housing containing the mat wrapped substrate is placed in a fixture and a compressive force is applied to the housing along the minor axis of the oval opening to deform the housing and increase the pressure to obtain a highly compressed mat along this axis. This is then followed by securing the end members to the opposed ends of the housing while the compressive force is being applied so as to retain the compressed shape of the housing along the minor axis and thereby maintain the increased pressure on the mat to increase the density thereof along the minor axis.

BRIEF DESCRIPTION OF THE DRAWINGS

Other objects, advantages, and features of the present invention will become apparent from the following detailed description of the invention when considered in conjunction with the following drawings in which:

FIG. 10 is a view of the oval-shaped housing of the catalytic converter according to the present invention being deformed into a predetermined optimum configuration by a vise-like device;

FIG. 11 is a view showing the catalyst coated substrate which forms a part of the catalytic converter being wrapped with a mat of insulating material;

FIG. 12 is a plan view of the device of FIG. 10 showing the wrapped substrate being stuffed into the housing while the latter is in the deformed state;

DETAILED DESCRIPTION OF THE DRAWINGS

Figure 1:
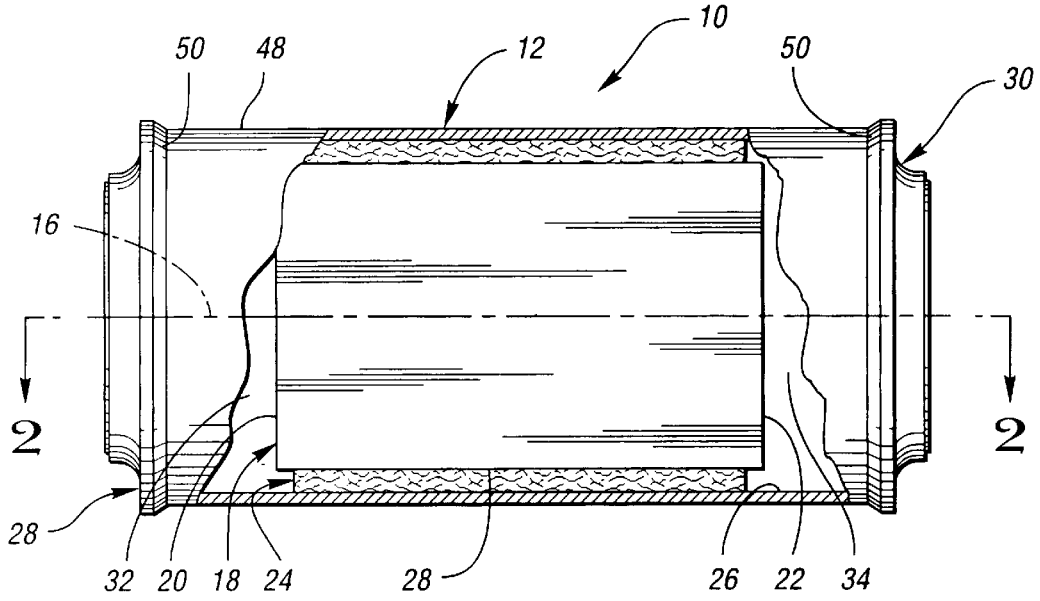
FIG. 1 is a side elevational view of a catalytic converter made in accordance with the invention with some parts broken away to show the interior of the converter.
Figure 2:
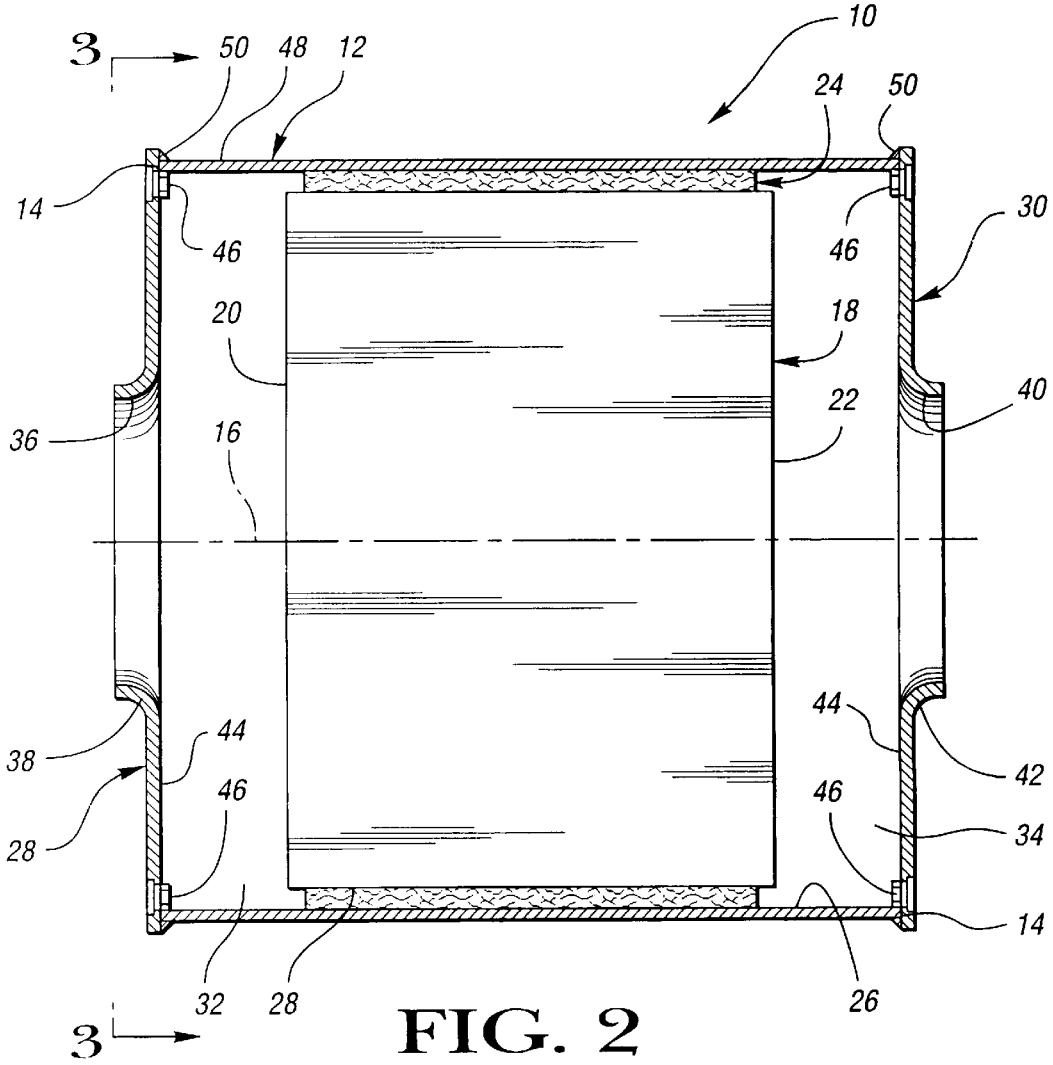
FIG. 2 is a sectional view of the catalytic converter taken on line 2—2 of FIG. 1.
Figure 3:
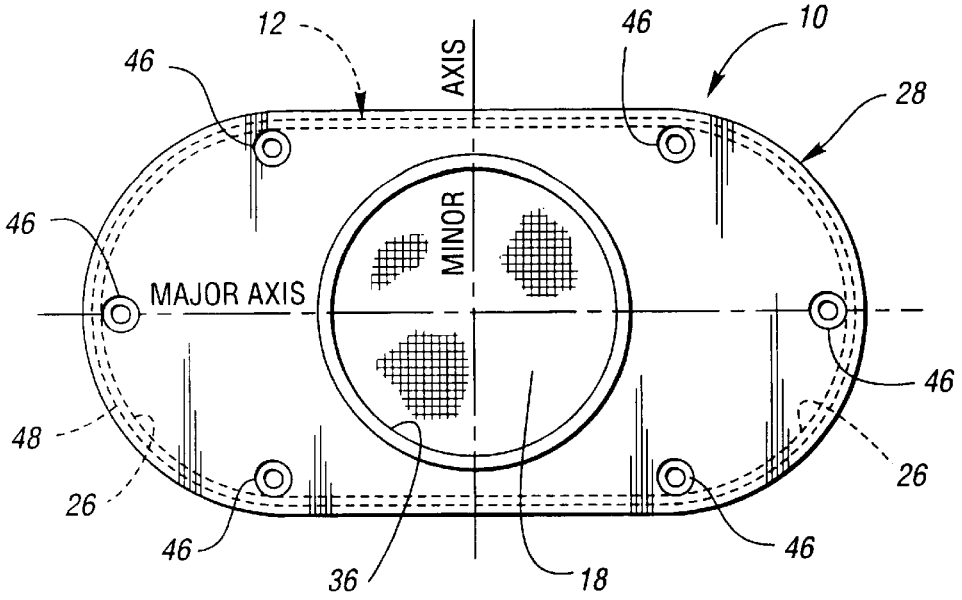
FIG. 3 is an end view of the catalytic converter taken on line 3—3 of FIG. 2.

Referring to the drawings and more particularly to FIGS. 1—3 thereof, a catalytic converter 10 made in accordance with the invention is shown that is intended for use in eliminating the undesirable constituents in the exhaust gases of an internal combustion engine. The catalytic converter 10 has an oval cross-sectional configuration providing a low profile configuration for installation under the vehicle floor or any other space constrained location. The catalytic converter 10 generally comprises an oval-shaped housing 12 which terminates at each end with an oval-shaped edge 14 defining an oval opening located in a plane extending transversely to longitudinal center axis 16 of the housing 12. The housing 12 is made from a sheet of stainless steel providing a uniform oval cross sectional cavity within the housing along its entire axial length. Also, the sheet of stainless steel is of uniform thickness and serves to enclose a monolith or substrate 18 made of a frangible material such as ceramic that is extruded with an identical honeycomb cross-section and an oval periphery. The ceramic substrate 18 is wash coated with a high surface area material and catalyzed with a precious metal such as platinum and/or palladium and/or rhodium. The catalyst serves to purify the exhaust gases exiting the internal combustion engine and entering the front face 20 of the substrate and exiting the rear face 22 of the substrate by reduction and oxidation processes well known to those skilled in the art.

As best seen in FIG. 2, the substrate 18 is centrally retained and solely supported within the housing by a mat 24 in the form of an oval-shaped sleeve. The mat 24 is made from a resilient, flexible and heat expandable intumescent material such as that known by the trade name "Interam" and is manufactured by Technical Ceramics Products Division of the 3M Company. As seen in FIGS. 1 and 2, the mat 24 covers essentially the entire outer surface of the substrate 18 and is interposed between the inside surface 26 of the housing 12 and the oval outer surface 28 of the substrate 18. The mat 24, as a supporting structure for the substrate 18, functions as a seal between the housing 12 and the substrate 18 and also as an insulator for limiting heat transfer between the substrate 18 and the housing 12 during the time that the hot exhaust gases flow through the catalytic converter 10. It has been found that unless the mat 24 is under a predetermined pressure during operation, the catalytic converter 10 must be placed in a location where the peak temperature of exhaust gasses is limited, for example, to no more than 850° C. at the inlet of catalytic converter 10 because higher temperature exhaust gases will cause the mat 24 to erode resulting in the mat 24 losing its insulating and supporting capabilities.

The opposed open ends of the housing 12 are closed by an oval-shaped inlet end member or plate 28 and an identically formed outlet end member on plate 30 so as to provide an inlet chamber 32 adjacent the front face 20 of the substrate 18 and an outlet chamber 34 adjacent the rear face 22 of the substrate 18. The inlet end plate 28 includes a circular inlet opening 36 defined by a radius transition 38 which is adapted to be rigidly connected to a cylindrical gas inlet pipe (not shown). Similarly, the outlet end plate 30 has a circular outlet opening 40 provided by a radius transition 42 which is adapted to be secured to a cylindrical exhaust gas outlet pipe (not shown) leading to the muffler (not shown) forming a part of the exhaust system in which the catalytic converter 10 is located. Normally, the outlet end plate 30 needs the radius transition 42 to minimize flow restriction across this transition. Although the inlet end plate 28 also includes a radius transition 38 in this instance, it will be noted that the radius transition 38 is not required. In other words, the radius transition 38 could be removed from the inlet end plate 28 and have the exhaust gas inlet pipe extend into the resulting opening formed in the inlet end plate 28. The end plates 28 and 30 are essentially planar in configuration providing a flat planar inner surface 44 for engagement with the oval peripheral edge 14 of the oval opening at each end of the housing 12. Moreover, each of the end plates 28 and 30 is made thicker than the side walls of the housing 12 so as to withstand the bending stresses of the exhaust system and, as seen FIGS. 1 and 2, are located in parallel planes which are perpendicular to the longitudinal center axis 16 of the housing 12. It should be apparent that the end plates 28 and 30 can assume other transverse positions relative to the longitudinal center axis 16 depending upon the location of the catalytic converter 10 in the vehicle exhaust system. For example, the end plates 28 and 30 can be angled relative to the longitudinal center axis 16 as seen in FIG. 1 or angled relative the same axis as seen in FIG. 2.

As seen in FIG. 3, each of the end plates 28 and 30 is formed with six identical locators 46, two of which are centered on the major axis of the oval opening in the housing 12 with the other four locators being positioned in pairs along spaced imaginary vertical lines which are perpendicular to the major axis an essentially intersect the major axis at a point which is the center of the a radius defining the end curvature of the inside surface 28 of the housing 12. Each of the locators 46 take the form of a button which, as seen in FIG. 2, projects inwardly towards the substrate 18 and is positioned so that it contacts the inside surface 26 of the housing 12 at the semi-circular end of the housing 12. As will be more fully explained hereinafter, the locators 46 are located in positions which define the final configuration of the oval opening in the housing 12 and, as seen in FIG. 3, serve to position each end plate so that a portion thereof extends radially outwardly beyond the outside surface of the housing for accepting a weld 50 for securing the end plate to the housing 12. Each end plate 28 and 30 is welded to the housing 12 around the entire circumference of the housing 12 adjacent the oval-shaped edge 14.

Figure 4:
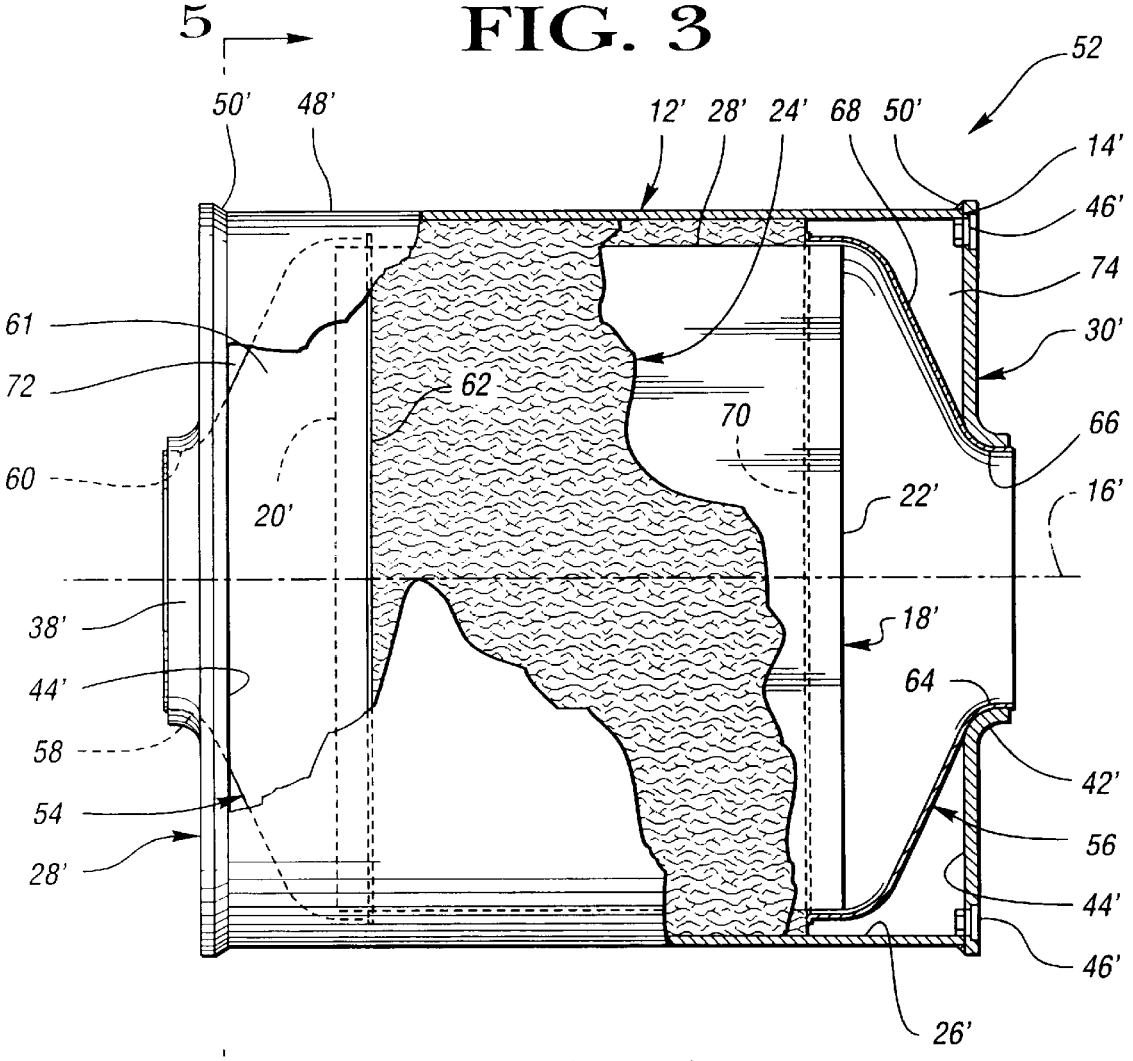
FIG. 4 is a plan view of a catalytic converter similar to that seen in FIGS. 1–3 except for the addition of an inner cone member in the interior of the converter.
Figure 5:
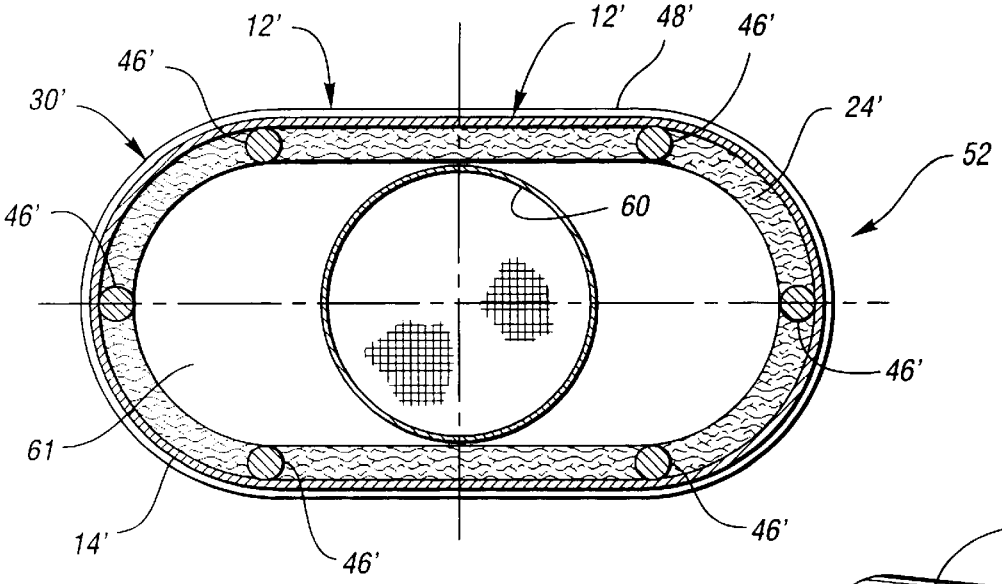
FIG. 5 is a sectional view taken on line 5—5 of FIG. 4.
Figure 6:
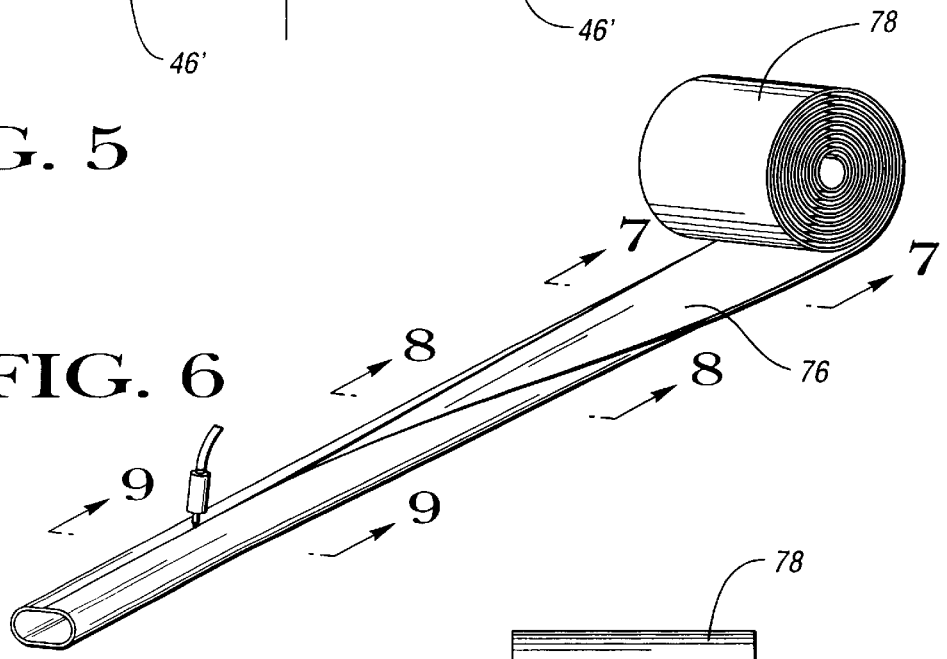
FIG. 6 is a perspective view showing a sheet of stainless steel being formed into an oval configuration which subsequently can be used as the housing for the catalytic converter seen in FIGS. 1–5.
Figure 7:
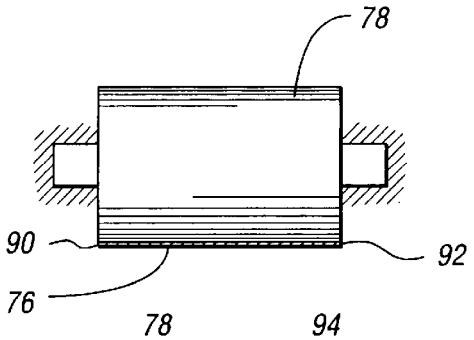
FIG. 7 is a view taken on line 7—7 of FIG. 6.
Figure 8:
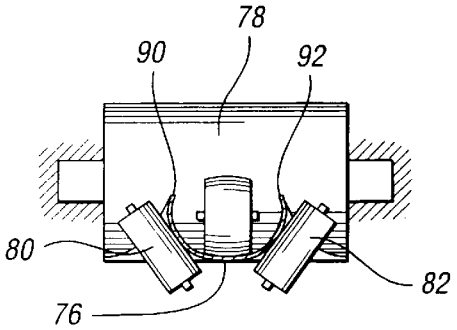
FIG. 8 is a view taken on line 8—8 of FIG. 8 showing one of the preliminary steps in forming of the sheet of stainless steel into the oval configuration.

FIGS. 4 and 5 disclose a catalytic converter 52 which is essentially the same in construction as the catalytic converter 10 except for the addition of an inlet cone member 54 and an outlet cone member 56. Accordingly, all parts of the catalytic converter 52 that are identical to parts of the catalytic converter 10 are identified by the same reference numerals but primed.

As seen in FIGS. 4 and 5, the cone member 54 is formed with a cylindrical section 58 which defines a circular inlet opening 60. The cylindrical section 58 is secured to the radius transition 38' by a weld and is integrally formed with a funnel section 61 which gradually increases in cross sectional area as it extends from the end plate 28' towards the front face 20' of the substrate 18' and terminates with an oval-shaped opening defined by an oval edge 62. As seen in FIG. 4, the edge 62 is located in a plane extending transversely to the longitudinal center axis 16' of the housing 12' and is perpendicular thereto. In addition, the edge 62 is slightly flared radially outwardly to facilitate mating with the front face portion of the substrate 18'. Accordingly, the oval-shaped opening defined by the edge 62 of the cone member 54 is slightly larger than the cross sectional size of the substrate 18' so, when the two mate, a close fit is provided around the periphery of the substrate 18'.

The cone member 56 is identical in construction to the cone member 54 and is also formed with a cylindrical section 64 which, in this case, defines a circular outlet opening 66. The cylindrical section 64 is rigidly fixed to the radius section 42' by a weld and is integrally formed with a funnel section 68 terminating with an oval-shaped edge 70 that encompasses the rear face portion of the substrate 18'.

One advantage in providing the cone members 54 and 56 in the housing 12' is that they form air chambers 72 and 74 with the end plates 28' and 30', respectively. The air chambers 72 and 74 surround the funnels sections of the cone members 54 and 56, respectively, and cooperate with the mat 24' to provide additional insulating capability to limit heat transfer between the substrate 18' and the housing 12'. This then would allow the catalytic converter 52 to be positioned within the exhaust system at a point closer to the engine than the catalytic converter 10 which does not enjoy the enhanced insulation provided by the use of the cone members 54 and 56. Another advantage would be to allow the use of lower cost materials such as a thinner housing or less mat for equivalent durability, or to allow the converter to operate under more severe temperature conditions.

Although not shown, it will be understood that the cylindrical sections 58 and 64 of the cone members 54 and 56, respectively, can be made as separate parts and be welded to the associated funnel sections. Also, if desired the transition radius 38' and 42' on the end plates 28' and 30' can be eliminated with each cylindrical section welded directly to the associated end plate.

At this juncture, it should be noted that inasmuch as both of the catalytic converters 10 and 52 comprise identical parts except for the addition of the cone members 54 and 56 in the catalytic converter 52, both catalytic converters 10 and 52 can be manufactured in accordance with the present invention by a method disclosed in FIGS. 6–12. However, in order to simplify the description of the method of manufacture, reference will only be made to the catalytic converter 10, it being understood that the same steps would be followed to make the catalytic converter 52.

In this regard and with reference to FIGS. 6–9, the housing 12 can be formed by a tube mill method for high volume jobs in a manner well known to those skilled in the art. In such case, a sheet 76 of stainless steel metal is drawn from a supply roll 78 through a series of paired rollers such as rollers 80 and 82 (FIG. 8) and is progressively bent into the final oval configuration by a pair of rollers such as rollers 84 and 86 (FIG. 9) to provide an inner oval cavity 88 of predetermined desired dimensions. The desired oval configuration of the cavity will depend upon the outside oval configuration of the substrate 18 and the radial thickness of the mat 24 to be used and would be determined by taking both into consideration as to be described below. For present purposes, however, it will suffice to say that in one method of making the catalytic converters 10 and 52, according to the present invention, the oval cavity 88 will be sized so when the substrate 18 alone (without the wrapped mat) is centrally positioned in the cavity 88, the radial distance between the inside surface of the cavity 88 and the outside surface of the substrate along the minor axis of the oval cavity 88 is less than the radial distance between the inside surface of the cavity 88 and the outside surface of the substrate along the major axis of the cavity. This essentially provides a housing having a cavity which could not accept the substrate 18 when it is wrapped with the mat.

Figure 9:
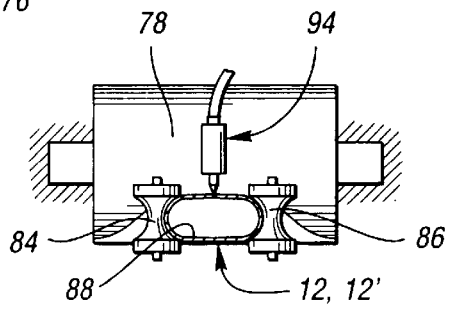
FIG. 9 is a view taken on line 9—9 showing the final step in the formation of the sheet of stainless steel into the oval-shaped configuration.

After the sheet metal 76 is formed into the desired oval configuration, the free ends 90 and 92 of the oval-shaped sheet metal are then welded together as seen in FIG. 9 using a tungsten-inert-gas arrangement wherein no material is added. Afterwards, the oval-shaped sheet metal is cut at an appropriate length to provide the housing 12 of the catalytic converter.

Inasmuch as the cavity 88 in the housing 12 will have the oval configuration described above, and as alluded to above, it will not be possible to insert the mat wrapped substrate into the cavity 88 of the housing 12 using conventional insertion apparatus without seriously damaging the mat and the substrate. Therefore, in order to accomplish the insertion, the housing 12 is placed into a vise-like device 96 as shown in FIG. 10. The device 96 includes a pair of jaws 98 and 100 each having a vertically aligned wall 102 centrally located between the top surface 104 and the bottom surface 106 of the associated jaw. The wall 102 merges with a pair of inwardly extending walls 108 and 110 each of which is located at a 45 degree angle relative to the major axis of the housing 12. The jaw 98 can be fixed in position while the other jaw 100 can be movable in a horizontal plane through an actuator (not shown).

The housing 12 is then positioned in the device 96 between the jaws 98 and 100 as shown in FIG. 10, and the jaw 100 is forcibly moved by the actuator in the direction of the arrow a predetermined distance 112 causing the housing to be deformed within its elastic limits so as to prevent permanent deformation of the housing and assume the configuration shown by the dotted lines. At this time, the distance between the inside surfaces of the housing 12 along the major axis is decreased and the distance between the inside surfaces of the housing 12 along the minor axis is increased. In effect, the deformed oval configuration obtained by this action is the configuration which would normally be used for accepting the particular substrate-mat assembly.

Once the housing 12 is deformed as described above, the cavity 88 of the housing 12 is ready for accommodating the substrate-mat assembly. The substrate 18 is then wrapped with the mat 24. The mat 24 can be a single sheet of intumescent material such as described earlier or can be two or more sheets of the material that, as an aggregate, would equal the thickness of the single sheet and provide the desired density when inserted into the cavity 88. In this case, as shown in FIG. 11, two sheets 114 and 116 of equal thickness that constitute the mat 24 are shown with the first sheet 114 having its ends abutting each other and secured to the substrate by a double- faced adhesive tape 118. The second sheet 116 is shown positioned above the abutting ends of the first sheet 114 and would be wrapped around the first sheet so that its abutting ends are located on the opposite side of the substrate. The second sheet 116 would also be secured to the first sheet by a double-faced adhesive tape.

After the two sheets 114 and 116 of intumescent material are wrapped around and secured to the substrate 18, the substrate-mat assembly is inserted into the cavity of the deformed housing 12 in the manner shown in FIG. 12. To do so, a stuffing cone 120 having a tapered wall 122 terminating with an oval opening 124 corresponding to the oval opening defined by the cavity 88 in the deformed housing 12 is attached to the device 96 after which the substrate-mat assembly is forcibly pushed into the cavity 88 of the housing to compress the mat to a predetermined density. Once the substrate-mat assembly is centrally positioned within the housing 12 as shown in FIGS. 1–5, the compressive force applied to the housing 12 by the device 96 is relieved. The inherent resilience within the metal of the housing 12 then causes the inside surfaces of the housing along the minor axis to "spring back" and move from the dotted line position towards the full line position see in FIG. 10 so that the pressure exerted on the sheets 114 and 116 along the major axis is decreased while simultaneously increasing the pressure on the sheets 114 and 116 along the minor axis of the housing 12.

With the sheets 114 and 116 now being subjected to the desired pressures along the major and minor axes of the housing 12, such pressures as well as the desired shape of the oval housing 12 are maintained by positioning the end plates 28 and 30 with the aid of the locators 46 onto the opposed ends of the housing 12 and securing them to the oval-shaped edge 14 through the welding operation. In the case of the catalytic converter 52, the inlet cone member 54 and the outlet cone member 56 would first be secured to the end plates 28' and 30' as described above, and the end plates 28' and 30' combined with the cone members 54 and 56 would then be secured to the housing 12.

In an example oval shaped catalytic converter, the housing is designed so that, if the substrate alone were positioned centrally within the oval cavity of the converter housing, a substantially uniform spacing of approximately 6.06 mm between the inside surface of the housing and the outside circumferential surface of the substrate would be provided. If this spacing was maintained after the substrate-mat assembly is inserted into the housing, then the theoretical mat density would be approximately 1.02 g/cc and the mat pressure against the substrate would be approximately 28 psi. However, it has been found that after insertion of the substrate-mat assembly within the housing, the spacing between the inside surfaces of the housing along the minor axis increases in size due to the pressure exerted by the mat on the upper and lower elongated walls of the housing. This growth between the substrate and the housing results in the radial spacing between the substrate and the inside surface of the housing along the minor axis increasing from 6.06 mm to approximately 7.22 mm. At that spacing, the mat density drops to approximately 0.86 g/cc and the mat pressure against the substrate falls to approximately 10 psi. At such values, a catalytic converter, such as seen in FIG. 1–3, that is designed so as to have the mat exposed to the direct impingement of the hot exhaust gas of the engine, must be located far enough from the vehicle engine so that the peak temperature of exhaust gases entering the catalytic converter is limited, for example, to 850° C., to prevent the problem of mat erosion and subsequent lose of support within the housing.

Accordingly, it has been determined that if the same housing and same substrate referred to above, is provided in its free form with a non-uniform spacing between the housing and the substrate alone so that, at the minor axis, the spacing is reduced from the 6.06 mm spacing to nominally 4.13 mm and afterwards subjected to the compressive force along the major axis as described above in connection with FIG. 10 after which the substrate-mat assembly is inserted into the housing (FIG. 12) and the applied force is released, the density of the mat as well as the pressure along the minor axis increases. This is true even though the housing experiences, in such case, a similar growth along the minor axis. The growth would be approximately 2.68 mm or, in this case, an increase from 4.13 mm to 6.81 mm. However, the spacing is less than the 7.22 mm spacing provided under initial conditions and, since the inherent resiliency within the stretched metal tends to cause the upper and lower walls of the housing to move inwardly, it has been calculated that the mat density along the minor axis would increase from 0.86 g/cc to approximately 0.91 g/cc and the mat pressure would increase from 10 psi to approximately 16 psi. At these values, the mat can withstand the high temperatures caused by the hot exhaust gases and is suitable for location closer to the vehicle engine where peak exhaust gas temperatures are higher, e.g., around 950° C., without deteriorating and losing its ability to support the substrate within the housing.

Figure 13:
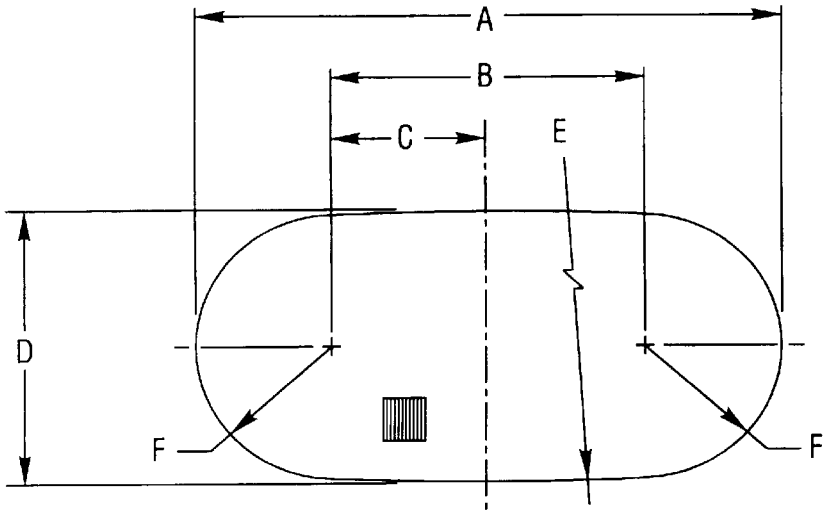
FIG. 13 is an end view of the substrate used in the catalytic converter according to the present invention.
Figure 14:
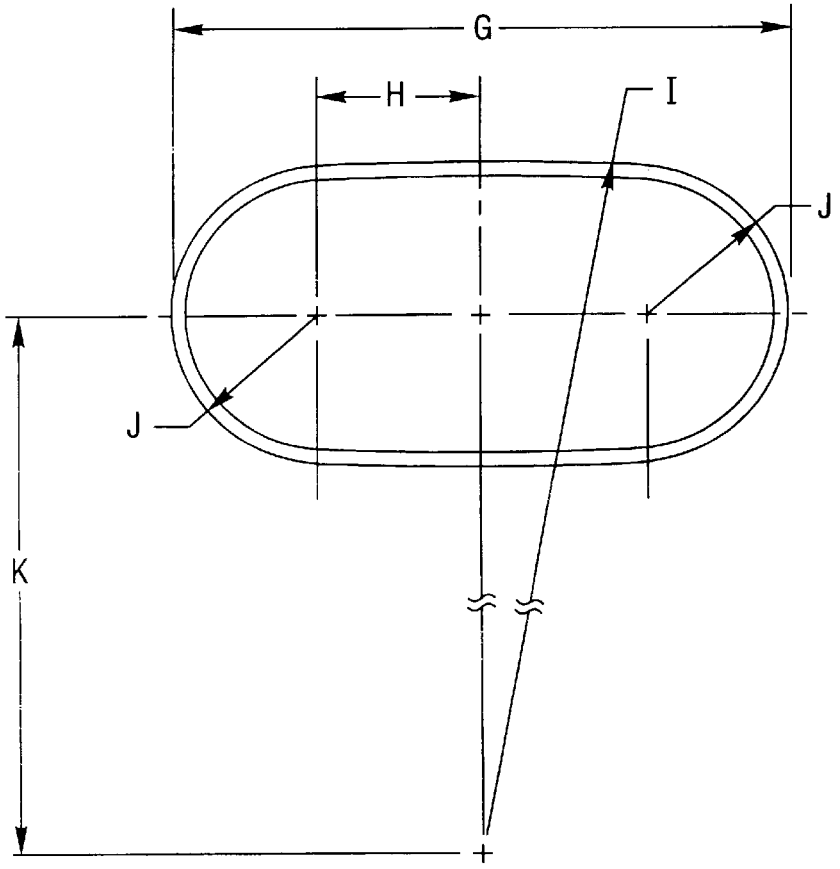
FIG. 14 is an end view of the oval-shaped housing used in the catalytic converter of FIGS. 1–5 having the optimum configuration prior to deformation by the apparatus seen in FIG. 10.

In the above example, the substrate as seen in FIG. 13 would have the following nominal dimensions: A=144.30 mm, B=80 mm, C=40 mm, D=68.07 mm, Radius E=457.2 mm, and Radius F=32.15 mm. As seen in FIG. 14, the housing would be made of a sheet of 409SS (stainless steel) having a thickness of 1.45 mm, a yield strength of 240Mpa and, in the free form prior to compression between the jaws of the device of FIG. 10, the following nominal dimensions: G=161.04 mm, H=41.90 mm, Outside Radius I=923.41 mm, Outside Radius J=38.62 mm, and K=883.80 mm. As seen in FIG. 11 two layers or sheets (each having a weight of 3100 grams per square meter and a thickness of approximately 4.9 mm) of mat made of intumescent material such as described hereinbefore would be wrapped around the substrate. The housing would be inserted into the device of FIG. 10 and the jaws would be drawn together in a compressive mode until the final distance between the two central walls along a horizontal line would be 159 mm.

An alternate method of increasing the pressure at the minor axis of the housing so as to improve the durability of a catalytic converter would be to form the sheet metal into an oval-shaped housing having an oval cavity dimensioned so that, when the substrate (described above) alone is centrally positioned within the oval opening of the cavity, the radial gap between the inside surface of the housing and the outside surface of the substrate is uniform about the circumference of the substrate and would be equal to approximately 6.06 mm. The substrate is then wrapped with the intumescent material having the weight and thickness described above and is then inserted into the cavity of the housing. This then will cause the housing to increase in size along the minor axis (as also described above) and, afterwards a compressive force is applied uniformly along the top surface and the bottom surface of the housing through a vise-like device. This would cause the inside top and bottom surfaces to move towards each other approximately 3.5 mm so as to provide a density of approximately 1.13 g/cc and a pressure of approximately 55 psi in the mat along the minor axis of the housing. While maintaining the pressure on the outside of the housing, the end plates would then be welded to the opposed ends of the housing so that the deformed and, accordingly, the pressure along the minor axis is maintained with the result that a higher mat density is realized along the top and bottom surfaces of the finished converter, or alternatively, using less compressive force to produce uniform mat density all around the finished converter.

Various changes and modifications can be made to the above described catalytic converter and method of manufacture without departing from the spirit of the invention. For example, rather than having end members of the type described in connection with the catalytic converter 10 or the catalytic converter 52, each of these catalytic converters could be provided with an end member that would have its periphery correspond in size with the final size of the oval opening in the housing. The end member then would fit into the opening and be welded to the inside surface defining the oval cavity for maintaining the final shape of the housing and the increased pressure along the minor axis of the housing. An alternate configuration of the end members that could be used with either of the catalytic converters 10 and 52 would have the periphery of the end plate provided with an integrally formed axially extending rim which, in this case, would be sized so as to correspond to the outside configuration of the housing at the peripheral oval edge thereof. The rim would enclose each end of the housing and be welded to the outside surface of the housing for maintaining the final shape of the housing. This alternate configuration of the end member could be planar in configuration, such as the end plate 28, 28' and 30, 30' or be similar in design to the end cone members if one could tolerate the increased size and weight of the catalytic converter.

Various other changes and modifications could be made to the above-described catalytic converter and method of manufacture without departing from the spirit of the invention. Such changes and modifications are contemplated by the inventors and they do not wish to be limited except by the scope of the appended claims.

We claim:

1. A method of manufacturing a catalytic converter structure for the treatment of the exhaust gases of an internal combustion engine and which includes a housing having an oval-shaped catalyst coated substrate mounted therein with its outer surface provided with a sheet of flexible material, said method comprising the steps of:

forming a sheet of metal into an oval-shaped housing that terminates at each end with an oval-shaped peripheral edge defining an oval opening located in a plane extending transversely to the longitudinal center axis of said housing and dimensioned so when said substrate alone is centrally located within said oval opening the gap between the inside surface of said housing and the outside surface of said substrate along the minor axis of said oval opening is less than the gap between the inside surface of said housing and the outside surface of said substrate along the major axis of said oval opening, applying a force to said housing so that the inside surfaces of said housing along said minor axis increase in distance and cause the inside surfaces of said housing along said major axis to decrease in distance so as to provide a temporarily deformed oval cavity within said housing, placing said sheet of flexible material on the body of said substrate to cover the latter and provide a substrate-flexible material assembly, inserting said substrate-flexible material assembly into said deformed oval cavity within said housing, relieving said force so as to cause said inside surfaces of said housing along said minor axis and along said major axis to spring back toward their original positions and provide a desired pressure to said sheet of flexible material along said minor axis and said major axis, and securing an end member to said oval-shaped peripheral edge at each end of said housing whereby said desired pressure along said minor axis and said major axis is maintained.

2. The method of claim 1 wherein said force is a compressive force applied to the outside of said housing along said major axis of said housing.

3. The method of claim 1 wherein said sheet of flexible material is secured to said substrate using a double faced adhesive.

4. The method of claim 1, wherein said substrate has a front face and a rear face and the body of the substrate is wrapped with said sheet of flexible material about the circumference of said substrate so as to cover substantially the entire substrate except said front face and said rear face.

5. The method of claims 1 wherein said sheet of flexible material provides a cover on said substrate that prior to insertion into said cavity is of uniform thickness about the circumference of said substrate.

6. The method of claim 1 wherein said gap is substantially uniform about the circumference of said substrate when said substrate alone is centrally positioned within said oval opening in said housing after application of said force and prior to insertion of said substrate-flexible material into said housing.

7. The method of claim 1 wherein said end member is planar in configuration and is secured to said housing by a welding operation.

8. The method of claim 7 wherein said end member is provided with a plurality of spaced locators and said locators serve to position each of said end members relative to said oval-shaped peripheral edge prior to welding said end member to said housing.

9. A method of manufacturing a catalytic converter structure for the treatment of the exhaust gases of an internal combustion engine and which includes a housing having an oval-shaped catalyst coated substrate mounted therein with its outer surface provided with a sheet of flexible material, said method comprising the steps of:

forming a sheet of metal into an oval-shaped housing that terminates at each end with an oval-shaped peripheral edge defining an oval opening located in a plane extending transversely to the longitudinal center axis of said housing and dimensioned so when said substrate alone is centrally located within said oval opening the gap between the inside surface of said housing and the outside surface of said substrate is uniform about the circumference of said substrate, placing said sheet of flexible material on the body of said substrate to substantially cover the latter and provide a substrate-flexible material assembly, inserting said substrate-flexible material assembly through said oval opening into said housing, applying a force to said housing so that the inside surfaces of said housing along said minor axis decrease in distance so as to provide increased pressure onto said sheet of flexible material to increase the density of said sheet along said minor axis without permanently deforming said housing, and securing an end member to said oval-shaped peripheral edge at each end of said housing to prevent said inside surfaces from springing back to their original positions when said force is relieved whereby said increased pressure along said minor axis and the resultant increased density of said sheet of flexible material along said minor axis is maintained permanently.

* * * * *